US006195846B1

(12) United States Patent
Studdiford et al.

(10) Patent No.: US 6,195,846 B1
(45) Date of Patent: Mar. 6, 2001

(54) FASTENER HAVING A BLOCK WITH CRADLE AND METHOD

(76) Inventors: Robert Douglas Studdiford, 1240 Elm St., El Cerrito, CA (US) 94530; Michael B. Dunn, 2458 Delmer St., Oakland, CA (US) 94602

( * ) Notice: Subject to any disclaimer, the term of this patent is extended or adjusted under 35 U.S.C. 154(b) by 0 days.

(21) Appl. No.: 09/368,484

(22) Filed: Aug. 4, 1999

(51) Int. Cl.[7] ..... A44B 18/00; B32B 3/06; B62J 11/00

(52) U.S. Cl. ..... 24/16 R; 24/17 B; 24/306; 24/442

(58) Field of Search ..... 24/16 R, 17 A, 24/17 B, 17 AP, 306, 442; 248/229.17; 224/901

(56) References Cited

U.S. PATENT DOCUMENTS

| | | | | |
|---|---|---|---|---|
| D. 344,967 | | 3/1994 | Webster . | |
| D. 357,171 | * | 4/1995 | Studdiford | D8/349 |
| 1,413,530 | | 4/1922 | Harned . | |
| 2,462,442 | | 2/1949 | Wallace . | |
| 3,632,069 | | 1/1972 | Thayer et al. . | |
| 3,632,071 | | 1/1972 | Cameron et al. . | |
| 3,947,927 | | 4/1976 | Rosenthal . | |
| 4,170,337 | | 10/1979 | Davis . | |
| 4,176,770 | | 12/1979 | Griggs et al. . | |
| 4,193,525 | | 3/1980 | Sommers . | |
| 4,310,110 | | 1/1982 | Dexter . | |
| 4,437,596 | | 3/1984 | Shook . | |
| 4,440,519 | | 4/1984 | Pennel et al. . | |
| 4,640,449 | | 2/1987 | Blackburn . | |
| 4,697,725 | | 10/1987 | Miree . | |
| 4,736,921 | * | 4/1988 | Zane et al. | 248/316.2 |
| 4,773,239 | | 9/1988 | Lowe et al. . | |
| 4,809,890 | | 3/1989 | Tsigadas . | |
| 4,909,051 | | 3/1990 | Lee . | |
| 4,939,818 | | 7/1990 | Hahn . | |
| 4,963,410 | * | 10/1990 | Bryant | 24/16 R |
| 4,998,652 | | 3/1991 | Champagne . | |
| 5,011,055 | | 4/1991 | Neugent . | |
| 5,020,706 | | 6/1991 | Birch . | |
| 5,027,478 | * | 7/1991 | Suhr | 24/16 R |
| 5,035,383 | | 7/1991 | Rainville . | |
| 5,076,526 | | 12/1991 | Zane et al. . | |
| 5,127,562 | | 7/1992 | Zane et al. . | |
| 5,133,568 | | 7/1992 | Balterman . | |
| 5,138,901 | | 8/1992 | Dabandjian et al. . | |
| 5,142,743 | | 9/1992 | Hahn . | |
| 5,144,546 | | 9/1992 | Burdi . | |
| 5,167,353 | | 12/1992 | Hughes . | |

(List continued on next page.)

FOREIGN PATENT DOCUMENTS

| | | | | |
|---|---|---|---|---|
| 1343400 | | 2/1964 | (FR) . | |
| 2063354 | | 6/1981 | (GB) . | |
| 80216374 | | 12/1980 | (TW) . | |
| 81208488 | | 6/1981 | (TW) . | |
| 82202110 | | 2/1982 | (TW) . | |
| 188576 | | 8/1992 | (TW) . | |
| 191491 | | 9/1992 | (TW) . | |
| 210710 | | 8/1993 | (TW) . | |
| 0001046 | * | 11/1979 | (WO) | 24/17 B |

*Primary Examiner*—Victor N. Sakran
(74) *Attorney, Agent, or Firm*—Coudert Brothers

(57) ABSTRACT

A block cradle fastener (10) having a strap (12) which comprises a top strap (12T) manufactured from hook material and a bottom strap (12B) manufactured from loop material. A block (14) securely mounted to the strap (12). The block (14) comprises a block top (14T) positioned on top of the top strap (12T) and a block bottom (14B) positioned on top of the bottom strap (12B). The top strap (12T) comprises a block top right (14TR) and a block top left (14TL) having a concave block top cradle (14TC) therebetween. The bottom strap (12T) comprises a block bottom right (14BR) and a block bottom left (14BL) having a concave block bottom cradle (14BC) therebetween.

9 Claims, 4 Drawing Sheets

U.S. PATENT DOCUMENTS

| | | | | |
|---|---|---|---|---|
| 5,181,774 | | 1/1993 | Lane . | |
| 5,226,341 | | 7/1993 | Shores . | |
| 5,326,055 | | 7/1994 | Page et al. . | |
| 5,395,018 | * | 3/1995 | Studdiford | 224/41 |
| 5,405,113 | | 4/1995 | Jaw . | |
| 5,464,135 | * | 11/1995 | Studdiford | 224/41 |
| 5,598,995 | | 2/1997 | Meuth et al. . | |
| 5,673,889 | * | 10/1997 | DeValcourt | 248/229.17 |
| 5,833,188 | * | 11/1998 | Studdiford et al. | 248/229.17 |

* cited by examiner

FASTENER HAVING A BLOCK WITH CRADLE AND METHOD

FIELD OF THE INVENTION

The present invention relates to fasteners. More particularly, the present invention relates to fasteners utilized for holding bundles of parallel items such as wires, cables, hoses, tubes, and other items of similar dimensions. Specific intended uses include fastening or bundling of Category 5 cable, fiber optic cable, intravenous tubing, automotive cabling and wiring, and aviation cabling and wiring.

BACKGROUND OF THE INVENTION

The prior art is generally concentrated in the field of bicycle accessory holders of which the inventor has several patents as described herein. The use of a similar device for holding parallel items such as wire, pipe or cable is novel.

The first known cycle lock patented in the U.S.A. is believed to have issued to Howard L. Pippen, see U.S. Pat. No. 1,402,725. Mounting means for bicycle accessories, including locks, have been patented over the years. See U.S. Pat. Nos. 1,629,859; 3,848,783; 3,924,426; and 3,967,475. In the mid 1970's, a bicycle lock and bracket comprising a U-shaped shackle and a cross piece were developed, see U.S. Pat. No. 4,155,231. A bracket for securing such a lock to a motorcycle is disclosed in U.S. Pat. No. 4,436,232. A bracket for mounting a pipe mast is shown in U.S. Pat. No. 2,916,237; while a holder for flexible tubing is disclosed in U.S. Pat. No. 3,747,166. Mounting a canteen astride a motorcycle handlebar is shown in U.S. Pat No. 4,176,770. Mounting an umbrella to a pipe is disclosed in British Patent No. 11,325, granted in 1897. Mounting of a cycle pump to a bicycle is shown in British Patent No. 555,662; and a two-way clip securing a ticket to a round bar is disclosed in French Patent No. 2,441,079.

A set of contoured clamps for bicycle locks, some featuring a winged nut, made of sheet metal, was disclosed in an application Ser. No. 467,609 filed Feb. 18, 1983 by the applicants herein, entitled, "Mounting Bracket for Bicycle Lock." Application Ser. No. 467,609 was, in part, abandoned since the product intended to be protected thereby had been rendered obsolete by a product now protected by U.S. Pat. No. 4,736,921,"Clamp for Holding Bicycle Lock," granted Apr. 12, 1988. The clamp of U.S. Pat. No. 4,736,921 is made of a hard resilient plastic material, as opposed to being formed of sheet metal. The present application is intended to protect an improved and more versatile version of a plastic fastener for releasably securing bicycle accessories to a bicycle frame.

Various bicycle accessories, including tire pumps, are desirably carried with the rider and affixed to the bicycle frame. Generally such items as a bicycle pump are connected to the frame by means of a holder mechanism that is bolted to the frame and has portions that can extend completely around the cylindrical pump body. Frequently some type of fastener, such as a bolt or other threaded member, is employed to attach the holder to the bicycle frame, and a manually operable fastener is employed to attach the pump body to the holder itself.

Numerous innovations for holders have been provided in the prior art that are described as follows. Even though these innovations may be suitable for the specific individual purposes to which they address, they differ from the present invention as hereinafter contrasted.

U.S. Pat. No. 5,395,018 to Studdiford entitled, "High Performance Lock Mount and Method," discloses a mount or holder apparatus and method for releasably securing a lock comprised of a U-shaped shackle and a cross-bar connected across the open end thereof to a bicycle. The holder comprises a plurality of mounting blocks, each mounting block having a first concave mounting surface of a predetermined axial length in which the lock may be cradled and an opposing second concave mounting surface of a predetermined axial length in which a portion of the bicycle may be cradled. The first and second concave mounting surfaces are positioned relative to each other so that the direction of the first axial length is transverse to the second axial length. Each mounting block includes a first means proximate the second concave mounting surface for securing the lock in the first concave mounting surface and a second means proximate to the first concave mounting surface for securing the bicycle in the second concave mounting surface.

U.S. Pat. No. 5,464,135 to Studdiford entitled, "High Performance Lock Mount and Method," discloses a mount or holder apparatus and method for releasably securing a lock comprised of a U-shaped shackle and a cross-bar connected across the open end thereof to a bicycle. The holder comprises a plurality of mounting blocks, each mounting block having a first concave mounting surface of a predetermined axial length in which the lock may be cradled and an opposing second concave mounting surface of a predetermined axial length in which a portion of the bicycle may be cradled. The first and second concave mounting surfaces are positioned relative to each other so that the direction of the first axial length is transverse to the second axial length. Each mounting block includes a first strap proximate the second concave mounting surface for securing the lock in the first concave mounting surface and a second strap proximate to the first concave mounting surface for securing the bicycle in the second concave mounting surface.

U.S. Pat. No. 5,833,188 to Studdiford et al. entitled, "Accessory Mounting Apparatus," discloses a mounting apparatus for releasably securing a bicycle accessory to a bicycle, which includes a fabric strap having a fabric strap first hook portion, a fabric strap first strap portion, a fabric strap second hook portion, a fabric strap first loop portion, a fabric strap second loop portion, a fabric strap second strap portion, a fabric strap buckle engagement portion, and a fabric strap buckle; and a mounting base defining a slot receiving the fabric strap therethrough and having a mounting base first curved portion, a mounting base second curved surface, a mounting base left slot opening and a mounting base right slot opening.

U.S. Pat. No. 5,673,889 to DeValcourt entitled, "Wind Surfing Equipment Holder," discloses a wind surfing equipment holder. The device comprises a pair of equipment holders each comprising a hollow, non-scuff bottomed base and a traversly disposed optionally telescoping stanchion. The top of the stanchion has a generally U-shaped saddle, with a slot on each end, located thereon. The wind surfing board is attached to a vehicle in usual fashion. Each equipment holder is placed on top of the board in spaced apart fashion and strapped in place. The boom is clamped to one stanchion and circumferentially fitted around the other stanchion and height adjusted into place. The mast is received within the saddle and the sail is positioned onto one side of the stanchions. A strap is fitted through the hollow base, around the sail and mast, through each slot of the saddle and tightened in place.

U.S. Pat. No. D357,171 to Studdiford entitled, "High Performance Mounting Block," discloses an ornamental design for a high performance mounting block.

The above patented inventions differ from the present invention because they fail to describe or claim at least one combination of the following features depicted in the present invention: a perpendicularly configured block top cradle and block bottom cradle lacking a strap buckle.

Numerous innovations for holders have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to fasteners. More particularly, the present invention relates to fasteners utilized for holding bundles of parallel items such as wires, cables, hoses, tubes, and other items of similar dimensions. Specific intended uses include fastening or bundling of Category 5 cable, fiber optic cable, intravenous tubing, automotive cabling and wiring, and aviation cabling and wiring.

The types of problems encountered in the prior art are holders and fasteners for wire, cable and pipe lack a cradle block which maintains parallel configuration.

In the prior art, unsuccessful attempts to solve this problem were attempted by employing hook and loop straps with buckles. The problem was solved by the present invention where the buckle was removed, a cradle block was added and the fastening function was retained.

Innovations within the prior art are rapidly being exploited in the field of fasteners and holders.

The present invention went contrary to the teaching of the art which describes and claims hook and loop holders with buckles lacking a cradle block.

The present invention solved a long felt need for a device to hold cables, wire, and pipe in a parallel configuration.

The present invention produced unexpected results namely: chafing between items was reduced due to the maintenance of the parallel configuration.

A synergistic effect was produced utilizing the present invention due to the following facts and results from experimentation: that due to the reduction of chafing, the product life was extended.

Accordingly, it is an object of the present invention to provide a block cradle fastener having a strap and block.

More particularly, it is an object of the present invention to provide the strap having a top strap and a bottom strap.

In keeping with these objects, and with others which will become apparent hereinafter, one feature of the present invention resides, briefly stated, in the block having a block top and a block bottom.

When the block top is designed in accordance with the present invention, it comprises a block top right, block top left, and a block top cradle therebetween.

In accordance with another feature of the present invention, the block bottom comprises a block bottom right, block bottom left, and a block bottom cradle therebetween.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10-block cradle fastener (10)

12-strap (12)

12T-top strap (12T)

12B-bottom strap (12B)

14-block (14)

14T-block top (14T)

14TR-block top right (14TR)

14TL-block top left (14TL)

14TC-block top cradle (14TC)

14B-block bottom (14B)

14BR-block bottom right (14BR)

14BL-block bottom left (14BL)

14BC-block bottom cradle (14BC)

DETAILED DESCRIPTION OF THE PREFERRED EMBODIMENT

Figure 1:
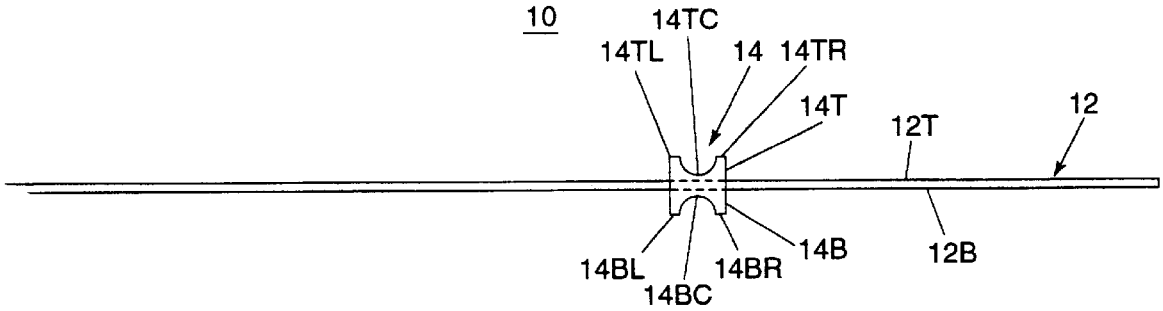
FIG. 1 is aside view of a block cradle fastener (10).
Figure 2:
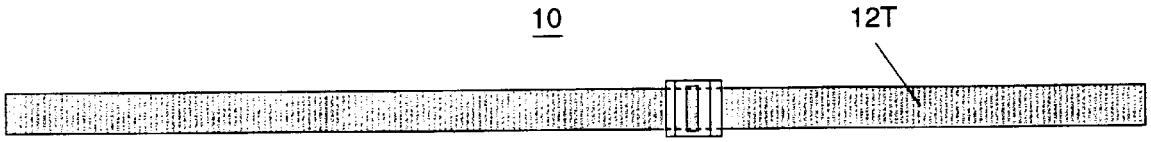
FIG. 2 is a top view of a block cradle fastener (10).
Figure 3:
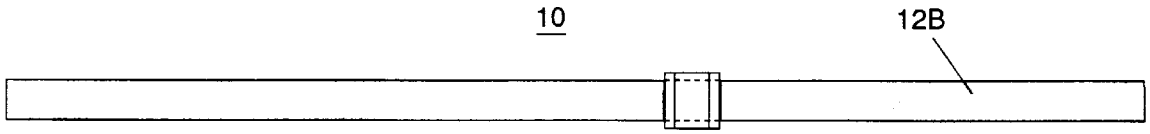
FIG. 3 is a bottom view of a block cradle fastener (10).
Figure 4:
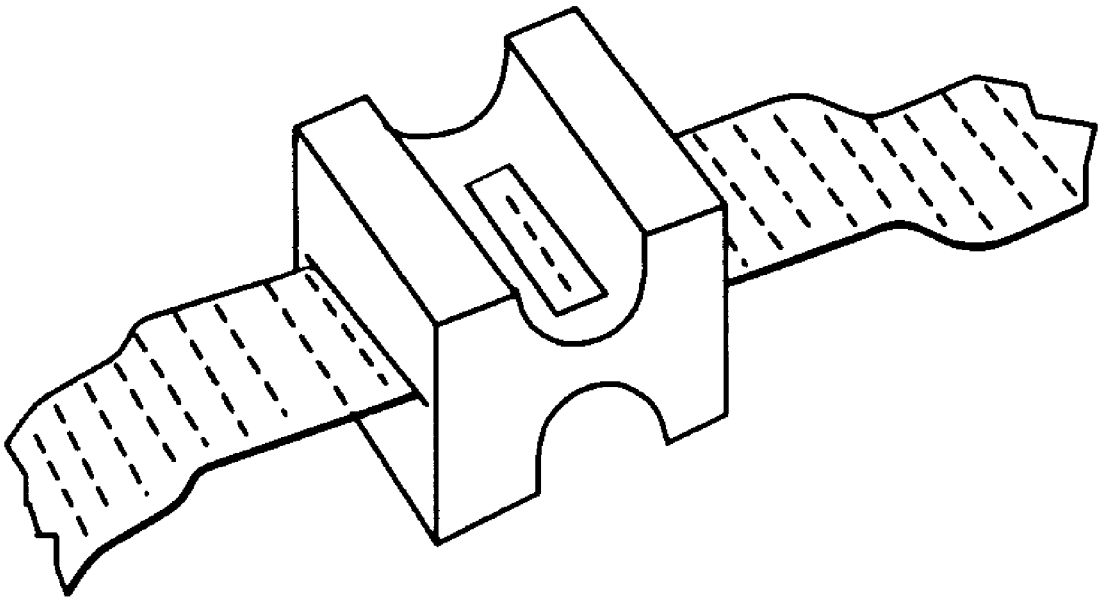
FIG. 4 is a perspective view of a block cradle fastener (10).

FIG. 1, FIG. 2, FIG. 3, and FIG. 4 are side, top, bottom and perspective views, respectively, of a block cradle fastener (10) comprising a strap (12) which comprises a top strap (12T manufactured from hook material and a bottom strap (12B) manufactured from loop material. The strap (12) is manufactured from a material selected from a group consisting of leather, leather composite, synthetic leather, plastic, natural fiber cloth, synthetic fiber cloth, metal, metal alloy, plastic composite, rubber and rubber composite. VELCRO® brand straps are particularly well suited.

The block cradle fastener (10) further comprises a block (14) securely mounted to the strap (12). The block (14) comprises a block top (14T) positioned on top of the top strap (12T) and a block bottom (14B) positioned on top of the bottom strap (12B). The top strap (12T) comprises a block top right (14TR) and a block top left (14TL) having a concave block top cradle (14TC) therebetween. The concave block top cradle (14TC) is configured perpendicularly to the strap (12). The bottom strap (12T) comprises a block bottom right (14BR) and a block bottom left (14BL) having a concave block bottom cradle (14BC) therebetween. The concave block bottom cradle (14BC) is configured perpendicularly to the strap (12). The block (14) is preferably manufactured from a malleable material. The malleable material is a thermoplastic elastomer. The malleable material is selected from a group consisting of rubber, rubber composite, silicone, polyurethane, and polyvinyl. KRATON® grade G2705 material manufactured by the Shell oil Co. is well suited. KRATON® has a tensile modulus of 400 p.s.i. at 300% elongation and a shore-A-hardness of 55. The block (14) comprises a slightly wider width than the strap (12). The block (14) is preferably molded to the strap (12). The block (14) may optionally have an internal slot which the strap (12) is slidably mounted therethrough.

It will be understood that each of the elements described above, or two or more together, may also find a useful application in other types of constructions differing from the type described above.

While the invention has been illustrated and described as embodied in a holder, it is not intended to be limited to the details shown, since it will be understood that various omissions, modifications, substitutions and changes in the forms and details of the device illustrated and in its operation can be made by those skilled in the art without departing in any way from the spirit of the present invention.

Without departing from the spirit and scope of this invention, one of ordinary skill in the art can make various changes and modifications to the invention to adapt it to various usages and conditions. As such, these changes and modifications are properly, equitably, and intended to be, within the full range of equivalents of the following claims.

What is claimed as new and desired to be protected by letters patent is set forth in the appended claims.

What is claimed is:

1. A block cradle fastener (10) for securing objects without the use of a strap buckle comprising:

a strap (12) which comprises a top strap (12T) manufactured from hook material and a bottom strap (12B) manufactured from loop material; and a block (14) securely mounted to the strap (12) in a manner which prevents relative motion between the strap (12) and the block (14), the block (14) comprises a block top (14T) positioned on top of the top strap (12T) and a block bottom (14) positioned on top of the bottom strap (12B), the top strap (12T) comprises a block top right (14TR) and a block top left (14TL) having a concave block top cradle (14TC) therebetween, the concave block top cradle (14TC) is configured perpendicularly to the strap (12), the bottom strap (12T) comprises a block bottom right (14BR) and a block bottom left (14BL) having a concave block bottom cradle (14BC) therebetween, the concave block bottom cradle (14BC) is configured perpendicularly to the strap (12).

2. The block cradle fastener (10) as described in claim 1, wherein the strap (12) is manufactured from a material selected from a group consisting of leather, leather composite, synthetic leather, plastic, natural fiber cloth, synthetic fiber cloth, metal, metal alloy, plastic composite, rubber and rubber composite.

3. The block cradle fastener (10) as described in claim 1, wherein the block (14) is manufactured from a malleable material.

4. The block cradle fastener (10) as described in claim 3, wherein the malleable material is selected from a group consisting of rubber, rubber composite, silicone, polyurethane, and polyvinyl.

5. The block cradle fastener (10) as described in claim 1, wherein the malleable material is a thermoplastic elastomer.

6. The block cradle fastener (10) as described in claim 1, wherein the block (14) comprises a slightly wider width than the strap (12).

7. The block cradle fastener (10) as described in claim 1, wherein the block (14) is molded to the strap (12).

8. The block cradle fastener (10) as described in claim 1, wherein the block (14) having an internal slot which the strap (12) is slidably mounted therethrough.

9. A method for fastening parallel items without the use of a strap buckle comprising:

providing a block cradle fastener having a strap (12) which comprises a top strap (12T) manufactured from hook material and a bottom strap (12B) manufactured from loop material;

securely mounting a block (14) to the strap (12) in a manner which prevents relative motion between the strap (12) and the block (14), the block (14) comprises a block top (14T) positioned on top of the top strap (12T) and a block bottom (14B) positioned on top of the bottom strap (12B), the top strap (12T) comprises a block top right (14TR) and a block top left (14TL) having a concave block top cradle (14TC) therebetween, the concave block top cradle (14TC) is configured perpendicularly to the strap (12), the bottom strap (12T) comprises a block bottom right (14BR) and a block bottom left (14BL) having a concave block bottom cradle (14BC) therebetween, the concave block bottom cradle (14BC) is configured perpendicularly to the strap (12);

securely holding a first parallel item in said block top; and securely holding a second parallel item in said block bottom.

* * * * *